US006232727B1

(12) United States Patent
Chee et al.

(10) Patent No.: US 6,232,727 B1
(45) Date of Patent: May 15, 2001

(54) CONTROLLING GAS DISCHARGE LAMP INTENSITY WITH POWER REGULATION AND END OF LIFE PROTECTION

(75) Inventors: Alland Chee, Union City; John B. Sampson, Morgan Hill, both of CA (US)

(73) Assignee: Micro Linear Corporation, San Jose, CA (US)

( * ) Notice: Subject to any disclaimer, the term of this patent is extended or adjusted under 35 U.S.C. 154(b) by 0 days.

(21) Appl. No.: 09/168,211

(22) Filed: Oct. 7, 1998

(51) Int. Cl.[7] ..... G05F 1/00

(52) U.S. Cl. ..... 315/307; 315/291

(58) Field of Search ..... 315/209 R, 307, 315/119, 225, 224, DIG. 7, 291, DIG. 4

(56) References Cited

U.S. PATENT DOCUMENTS

| | | | | |
|---|---|---|---|---|
| 3,611,021 | * | 10/1971 | Wallace | 315/239 |
| 4,207,498 | * | 6/1980 | Spira et al. | 315/97 |
| 4,210,846 | * | 7/1980 | Capewell et al. | 315/121 |
| 4,251,752 | * | 2/1981 | Stolz | 315/206 |
| 4,277,726 | * | 7/1981 | Burke | 315/98 |
| 4,414,493 | * | 11/1983 | Henrich | 315/308 |
| 4,441,054 | * | 4/1984 | Bay | 315/219 |
| 4,453,109 | * | 6/1984 | Stupp et al. | 315/219 |
| 4,495,446 | * | 1/1985 | Brown et al. | 315/206 |
| 4,498,031 | * | 2/1985 | Stupp et al. | 315/307 |
| 4,523,131 | * | 6/1985 | Zansky | 315/307 |
| 4,528,482 | * | 6/1985 | Merlo | 315/291 |
| 4,572,988 | * | 2/1986 | Handler et al. | 315/209 R |
| 4,585,974 | * | 4/1986 | Stupp et al. | 315/307 |
| 4,604,552 | * | 8/1986 | Allay et al. | 315/176 |
| 4,612,479 | * | 9/1986 | Zansky | 315/194 |
| 4,686,427 | * | 8/1987 | Burke | 315/219 |
| 4,698,554 | * | 10/1987 | Stupp et al. | 315/304 |
| 4,700,113 | * | 10/1987 | Stupp et al. | 315/224 |
| 4,717,863 | * | 1/1988 | Zeiler | 315/307 |
| 4,723,098 | * | 2/1988 | Grubbs | 315/306 |
| 4,739,227 | * | 4/1988 | Anderson | 315/260 |
| 4,763,239 | * | 8/1988 | Ball | 363/98 |
| 4,893,059 | * | 1/1990 | Nillsen | 315/127 |
| 4,920,299 | * | 4/1990 | Presz et al. | 315/98 |
| 4,935,669 | * | 6/1990 | Nillsen | 315/105 |
| 4,952,849 | * | 8/1990 | Fallows et al. | 315/307 |
| 5,048,033 | * | 9/1991 | Donahue et al. | 372/38 |
| 5,049,790 | * | 9/1991 | Herfurth et al. | 315/291 |
| 5,111,118 | * | 5/1992 | Fellows et al. | 315/307 |
| 5,315,214 | | 5/1994 | Lesea | 315/209 R |
| 5,381,076 | * | 1/1995 | Nerone | 315/307 |
| 5,705,894 | * | 1/1998 | Krummel | 315/119 |
| 5,770,926 | * | 6/1998 | Choi et al. | 315/307 |
| 5,808,422 | * | 9/1998 | Venkitasubrahmanian et al. | 315/225 |
| 5,883,473 | * | 6/1998 | Li et al. | 315/225 |
| 5,962,981 | * | 10/1999 | Okude et al. | 315/128 |

* cited by examiner

*Primary Examiner*—Haissa Philogene
*Assistant Examiner*—Chuc D Tran
(74) *Attorney, Agent, or Firm*—Haverstock & Owens LLP

(57) ABSTRACT

A method and apparatus for controlling the operation of a gas discharge lamp including regulation of power provided to the lamp for maintaining a preselected illumination intensity, automatic lamp shut down for preventing a catastrophic failure of the lamp, and automatic selection of operating frequencies for increasing efficiency and extending useful life of the lamp. An appropriate quality factor Q is achieved by including a low pass filter followed by a high pass filter in the lamp network so as to allow deep dimming of the lamp. Preferably, the arc power delivered to the lamp network is sensed and regulated. By sensing the arc power instead of only the lamp current, the illumination intensity of the lamp is accurately regulated. Further, the lamp ballast is automatically shut down near the end of the lamp's useful life, before operation in partial rectification. Preferably, power to the lamp is shut off based on the arc power entering the lamp network instead of relying only on the voltage of the lamp to avoid unnecessarily shutting down the lamp. The lamp network is automatically operated at an appropriate frequency selected from among a plurality of predetermined frequencies according to the lamp's present mode of operation including: preheating, starting, and continuous operation. Preferably, each frequency is optimized for the particular lamp and for the particular mode of operation.

18 Claims, 7 Drawing Sheets

Power delivered to lamp = VDC * V(N2)/R1
Example
VTH=1.0V
R1=5
VDC=380V
When Lamp Power > 80 Watts
V(n2) > VTH

CONTROLLING GAS DISCHARGE LAMP INTENSITY WITH POWER REGULATION AND END OF LIFE PROTECTION

FIELD OF THE INVENTION

The invention relates to the field of control circuits for gas discharge lamps. In particular, the invention relates to control circuits for gas discharge lamps that monitor and regulate the power provided to the gas discharge lamps.

BACKGROUND OF THE INVENTION

Gas discharge lamps, such as conventional fluorescent lamps, offer substantial improvements over incandescent lamps, including higher energy efficiency and longer life. A drawback to fluorescent lamps, however, is that they can be difficult to control. This is due, in part, because they have "negative resistance." This means that the operating voltage decreases as current through the lamp increases. Therefore, circuits for supplying power to fluorescent lamps generally require a electronic ballast to maintain operating stability of the circuit and to provide an ability to dim the lamp.

During a typical manufacturing process for gas discharge lamps, the lamps are optimized to provide a maximum light output with a minimum amount of energy consumption. Different capacity gas discharge lamps having different lumen outputs are each designed for a different optimum voltage level. The benefits of high energy efficiency and long lamp life require that the ballast provide the gas discharge lamp with the optimum lamp voltage and which appropriately control the current for adjusting the light output of the lamp.

A conventional non-adjustable ballast provides a fixed lamp voltage and lamp current for a lamp with a specific lumen output. As a gas discharge lamp ages, however, the lamp deteriorates which causes the impedance of the lamp to increase. When such a lamp is operated with a non-adjustable ballast, this deterioration causes the lamp output to become increasingly dim over time. Accordingly, even though the non-adjustable ballast is initially optimized for the particular lamp, over time, the lamp output becomes increasingly dim and efficiency decreases.

A prior alternative to a conventional non-adjustable ballast is an adjustable fixed ballast. The adjustable fixed ballast allows the lamp current and lamp voltage to be adjusted by the user in an attempt to optimize a particular gas discharge lamp for a specific light output intensity. This allows gas discharge lamps of different capacities to be used in conjunction with identical ballasts. However, as stated above, the impedance of gas discharge lamps increases over time. Thus, over time, the gas discharge lamp will produce an increasingly dimmer light output and efficiency decreases. Therefore, optimization will be lost unless the user re-adjusts the ballast.

An approach to some of the problems associated with an adjustable fixed ballast is an electronic self-adjusting ballast. A common technique by which such a self-adjusting ballast regulates a gas discharge lamp is by sensing and controlling the current in the lamp. One problem with regulating only the lamp current is that the light output of the lamp is more closely related to the arc power of the lamp than to the lamp current. The arc power is equal to the product of lamp current and lamp voltage. Lamp voltage, however, is dependent on the temperature of the lamp. Therefore, if only current is regulated, the arc power and, hence, light output, will vary with the temperature of the lamp.

Another problem associated with gas discharge lamps is safety. When the gas discharge lamp is near the end of its useful life, the gas discharge lamp can continue to operate in a condition of partial rectification. When operating in partial rectification, there is a high cathode fall voltage in the region of a depleted cathode. Accordingly, operation in partial rectification causes excessively high power dissipation in the region of the depleted cathode. Further, when only lamp current is regulated, increases in the impedance of the lamp caused by aging results in increased power dissipation. As a result of these factors, portions of the gas discharge lamp can reach excessive temperatures. This can present a dangerous fire hazard and can cause the glass envelope of the lamp to shatter. This can pose an immediate safety hazard for persons in the vicinity of the lamp.

Although gas discharge lamps tend to be more efficient than their incandescent counterparts, it is advantageous for gas discharge lamps to operate in a dimmed mode. By operating in a dimmed mode, the light intensity from the gas discharge lamp can be adjusted according to the needs or tastes of the user. Unfortunately, prior control circuits for gas discharge lamps, especially small diameter lamps such as the T4, generally cannot operate in a dimmed mode below approximately 40% of the lamps' rated illumination output without the lamp extinguishing itself or flickering excessively.

A prior art electronic ballast and network for gas discharge lamps is described in U.S. Pat. No. 5,315,214 and shown in FIG. 1. FIG. 1 illustrates a prior art circuit which controls the illumination intensity of the lamp by controlling the current passing through the lamp. This prior art circuit also shuts off the lamp circuit when the lamp voltage exceeds a preselected threshold. Further, this prior art circuit utilizes a low pass filter at the output lamp network to allow the lamp to be dimmed. These features of operating of the circuit shown in FIG. 1 are disadvantages for the following reasons. Because the lamp current remains constant, the illumination intensity of the lamp will vary with impedance changes caused by aging of the lamp. Further, by sensing lamp voltage to determine when to shut down, in the case of a removed or unlit lamp, this prior art lamp circuit does not protect the lamp from circumstances when the lamp current remains constant and the lamp voltage rises thus causing excess power to dissipate into the lamp. Finally, this prior art lamp circuit does not allow the lamp, especially a small diameter lamp such as the T4, to be dimmed below approximately 40% without extinguishing itself or excessively flickering because of a high quality factor Q lamp network.

Therefore, what is needed is a control circuit for a gas discharge lamp that overcomes these disadvantages.

SUMMARY OF THE INVENTION

The present invention is a method and apparatus for controlling the operation of a gas discharge lamp including regulation of power provided to the lamp for maintaining a preselected illumination intensity, automatic lamp shut down for preventing a catastrophic failure of the lamp, and automatic selection of operating frequencies for increasing efficiency and extending useful life of the lamp. The invention also provides an appropriate quality factor Q for the lamp network so as to allow the lamp to be dimmed to low levels, referred to as "deep dimming" or "architectural dimming," while maintaining operation of the lamp. An example of a gas discharge lamp is a commercially available fluorescent lamp commonly used in office, factory and commercial retail settings.

Preferably, the present invention measures the arc power delivered to the lamp network and regulates the power received by the lamp. By sensing the arc power instead of only the lamp current, the present invention accurately regulates the illumination intensity of the lamp. This is true despite the impedance of the lamp changing due to aging and despite the lamp voltage being affected by temperature changes. Further, the present invention preferably also automatically shuts down the lamp ballast near the end of the lamp's useful life and before operation in partial rectification occurs. Preferably, power to the lamp is shut off based on the arc power entering the lamp network instead of relying only on the voltage of the lamp. This avoids unnecessarily shutting down the lamp.

In addition, the present invention also automatically operates the lamp network at an appropriate frequency selected from among a plurality of predetermined frequencies. The appropriate frequency is selected according to the lamp's present mode of operation including: preheating, starting, and continuous operation. Preferably, each frequency is optimized for the particular lamp and for the particular mode of operation.

Further, the preferred embodiment of the present invention includes a lamp network that has a low pass filter followed by a high pass filter coupled to the lamp in series. As the lamp is dimmed, the lamp goes into a region of high negative resistance and is more prone to being extinguished or excessively flickering. This configuration of the lamp network results in a lower the quality factor Q and allows the lamp to continue operation during deep dimming.

DETAILED DESCRIPTION OF THE PREFERRED EMBODIMENT

Figure 1:
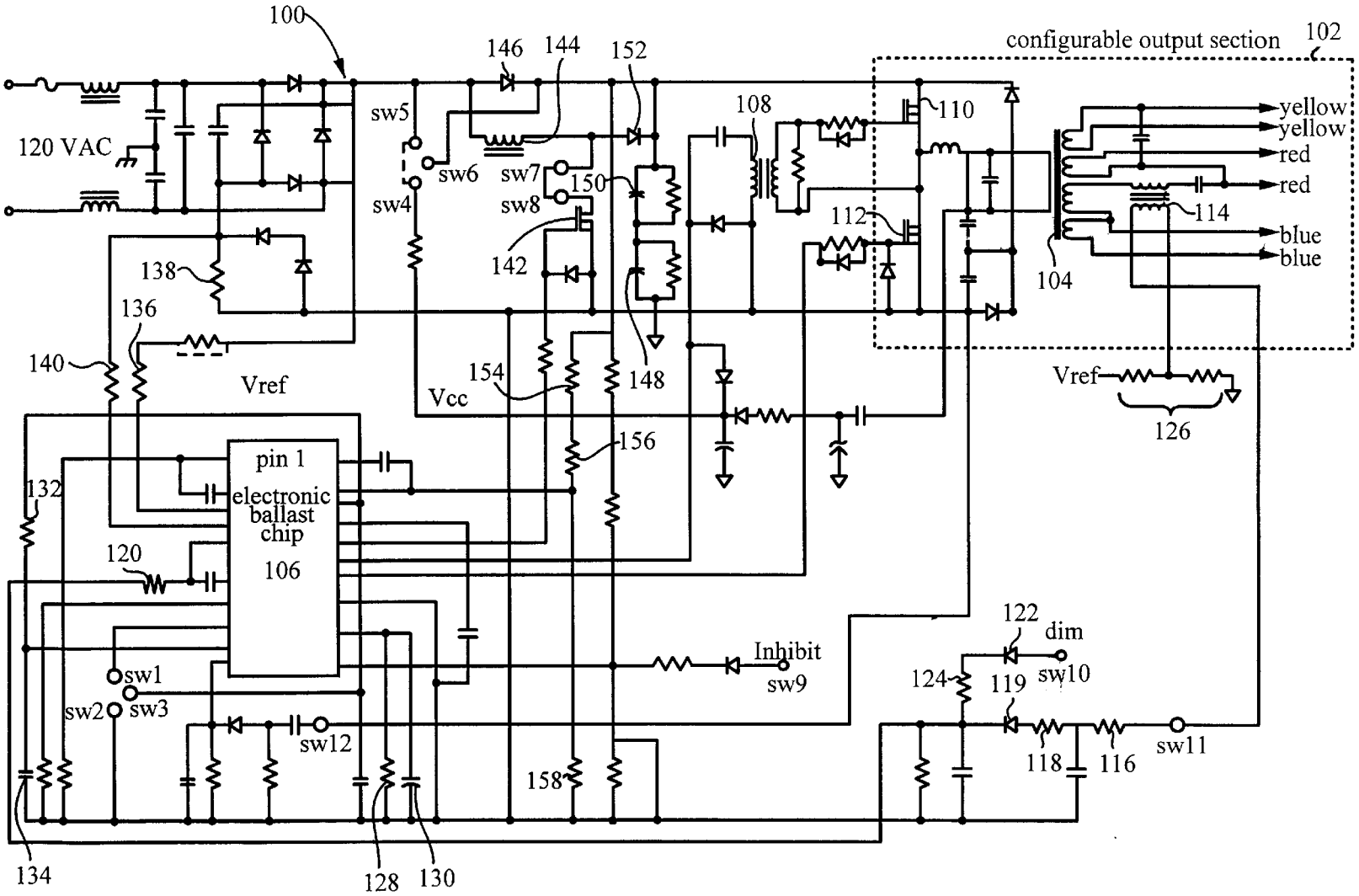
FIG. 1 illustrates a prior art schematic diagram showing an electronic ballast controller integrated circuit.
Figure 2:
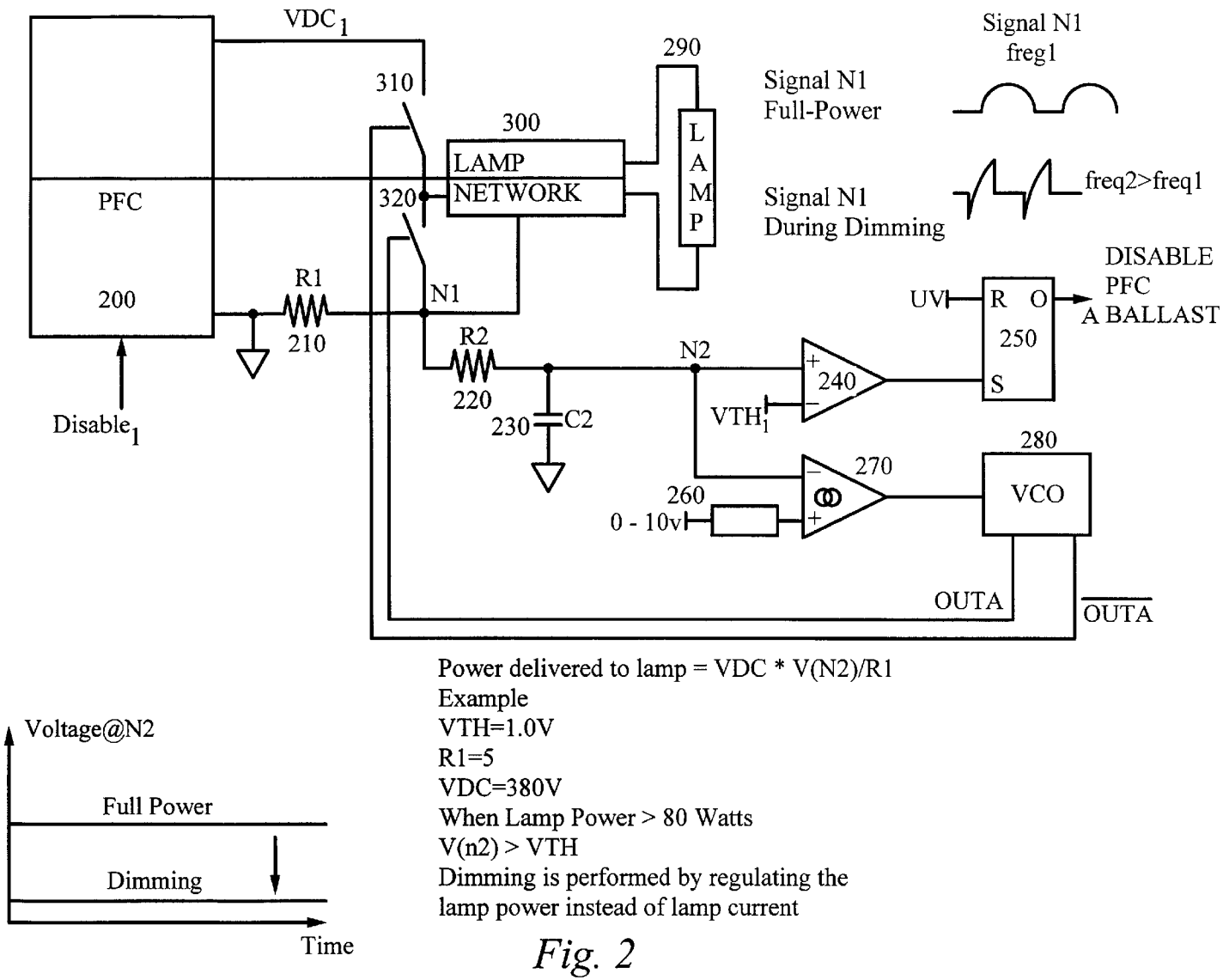
FIG. 2 illustrates a first embodiment of the present invention showing a circuit for regulating power received by a gas discharge lamp to maintain a constant illumination and for shutting down the lamp before partial rectification occurs based on power received by the lamp.

FIG. 2 illustrates a first embodiment of a power regulating circuit according to the present invention which controls a level of power provided to a gas discharge lamp 290 for controlling an illumination intensity of the lamp 290. The level of power provided to the lamp 290 is sensed by providing a regulated voltage to a lamp network 300 and by sensing current leaving the lamp network 300. The power provided to the lamp network 300 is controlled by adjusting a switching frequency of an inverter which comprises switches 310 and 320. Further, the power regulating circuit illustrated in FIG. 2 automatically shuts off power to the lamp 290 near the end of the useful life of the lamp 290 so as to avoid a potentially dangerous catastrophic failure of the lamp 290. This accomplished by disabling a power factor correction circuit (PFC) 200 when regulation of the power provided to the lamp fails to prevent the power from exceeding a predetermined level. These features of power regulation and automatic shutoff are not affected by variations in the temperature of the lamp 290.

In FIG. 2, the PFC circuit 200 has two output terminals across which a regulated direct-current voltage $VDC_1$ is provided for supplying the lamp network 300 and the lamp 290 with power. The voltage $VDC_1$ is preferably between 380 and 460 volts. An AC power source (not shown) supplies power to the PFC circuit 200. A first output terminal of the PFC circuit 200 is coupled to a first terminal of the switch 310. A second terminal of the switch 310 is coupled to an input terminal of the lamp network 300 and to a first terminal of the switch 320. A second terminal of the switch 320 is coupled to a first terminal of a resistor 210 and to a first terminal of a resistor 220, thereby forming a node N1. A second terminal of the resistor 210 is coupled to a second output terminal of the PFC circuit 200 and to a ground node. A second terminal of the resistor 220 is coupled to a positive terminal of a capacitor 230, to a positive input terminal of a comparator 240 and to a negative input of an amplifier 270, thereby forming a node N2. A negative terminal of the capacitor 230 is coupled to the ground node.

The lamp network 300 has two output terminals. A first output terminal of the lamp network 300 is coupled to a first terminal of the lamp 290. Additionally, a second output terminal of the lamp network 300 is coupled to a second terminal of the lamp 290.

As mentioned, the present invention senses the current received by the lamp network 300 for regulating a level of power provided to the lamp 290 and for providing automatic shut off of power to the lamp 290 when the lamp 290 reaches the end of its useful life. Because the voltage $VDC_1$ is regulated, the current from the lamp network 300 which flows through the resistor 210, is representative of a level of power provided to the lamp network 300.

Accordingly, a voltage $V_{N1}$ developed across the resistor 210 at the node N1 is representative of the level of instantaneous power provided to the lamp network 300. The voltage $V_{N1}$, however, is affected by the present condition of the switches 310 and 320.

In combination, the capacitor 230 and the resistor 220 form a low pass filter such that the resulting voltage $V_{N2}$ at the node N2 represents the average value or DC value of the voltage at the node N1. Accordingly, the voltage $V_{N2}$ is representative of the level of power provided to the lamp network 300 averaged over several cycles of the switches 310 and 320 (i.e. power delivered to the lamp=$VDC_1 * V_{N2}/R_{210}$).

A user-adjustable attenuator 260 is coupled to a positive terminal of the amplifier 270.

The attenuator 260 preferably provides a voltage in a range from 0 to 10 volts. As explained herein, adjustment of the voltage provided to the amplifier 270 by the attenuator 260 adjusts the illumination intensity of the lamp 290.

An output from the amplifier 270 is coupled to an input terminal of a voltage controlled oscillator (VCO) 280. The VCO 280 has two output terminals, OUTA and $\overline{OUTA}$.

A first output terminal OUTA of the VCO 280 is coupled to control the switch 310. A second output terminal $\overline{\text{OUTA}}$ of the VCO 280 is coupled to control the switch 320. The voltage levels at the terminals OUTA and $\overline{\text{OUTA}}$ are complementary in that one, and only one, of the switches 310 and 320 is on (closed) at any one time while the other is off (open).

The power provided to the lamp network 300 is regulated according the frequency at which the VCO 280 operates the switches 310 and 320. More particularly, the power is inversely related to the frequency over a certain range of frequencies. The frequency of the VCO 280 is controlled according to a difference between the voltage level $V_{N2}$ at the node N2 and a voltage provided by the attenuator 260. Further, a feedback loop is formed by the amplifier 270, the voltage controlled oscillator 280, and the switches 310 and 320 for regulating the voltage $V_{N2}$ at the node N2. Thus, by controlling the voltage at the node N2 in a feedback loop, the power provided to the lamp 290 is controlled such that the user selected illumination intensity output for the lamp 290 is maintained despite variations in temperature of the lamp or impedance changes caused by aging.

A negative input terminal of the comparator 240 is biased to a predetermined threshold voltage $VTH_1$. An output terminal of the comparator 240 is coupled to set input terminal S of an RS flip flop 250. An output terminal Q of the RS flip flop 250 is coupled to a disable switching in the PFC circuit 200 and the VCO 280 thereby disabling the PFC circuit 200 and the VCO 280. A reset input R on the RS flip flop 250 is coupled to an under-voltage (UV) signal for re-setting the flip flop 250. The RS flip flop 250 delivers lamp shut off signal $DISABLE_1$ to the PFC 200 and the VCO 280 when the voltage at the positive terminal of the comparator 240 exceeds the predetermined threshold voltage $VTH_1$.

These elements of the present invention automatically shut off the lamp 290 when the lamp nears the end of its useful life. For example, operation in partial rectification can trigger shut down of the lamp 290. To implement this function, the DC voltage at the node N2 is supplied to the comparator 240. When the voltage $V_{N2}$ at the node N2 exceeds the predefined threshold voltage $VTH_1$, this indicates that the power provided to the lamp 290 can no longer controlled to an appropriate level due to deterioration of the lamp 290. Accordingly, the comparator 240 sets the RS flip flop 250, which in turn deactivates the PFC 200 and the VCO 280, thereby shutting off power to the lamp 290. The predefined threshold voltage $VTH_1$ is preferably set at a level higher than a typical, normal voltage at the node N2 during safe operation of the lamp 290 such that the comparator 240 provides the signal to shut off power to the lamp 290 only when the voltage at the node N2 reaches unsafe levels.

In the preferred embodiment, the output terminal Q of the RS flip flop 250 disables the PFC 200 and the VCO 280 by disabling a clock signal (not shown) utilized for controlling switching in the PFC circuit 200 and the VCO 280. When the PFC 200 and the VCO 280 are shut down, the voltage $VDC_1$ falls to low level and little or no power is supplied to the lamp network 300 or to the lamp 290.

Figure 3:
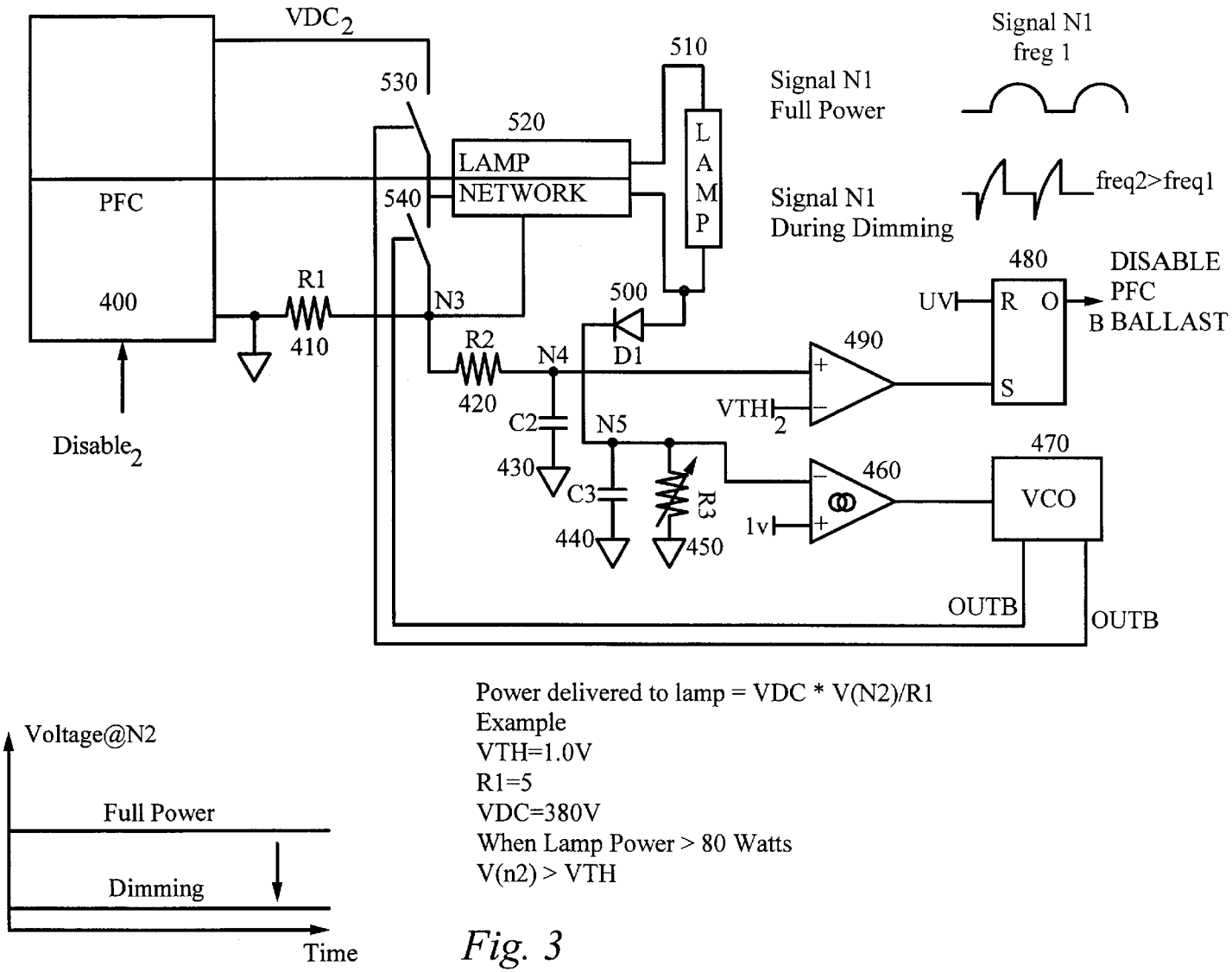
FIG. 3 illustrates a second embodiment of the present invention showing a circuit for regulating current received by a gas discharge lamp to maintain a constant illumination and for shutting down the lamp before partial rectification occurs based on power received by the lamp.

FIG. 3 illustrates a second embodiment of a power regulating circuit according to the present invention which controls a level of power provided to a gas discharge lamp 510 for controlling an illumination intensity of the lamp 510. This feature of power regulation is accomplished by measuring the current received by the lamp 510 via a diode 500. Similar to FIG. 2, FIG. 3 also incorporates an automatic shutoff feature which prevents the lamp 510 from operating in partial rectification so as to avoid catastrophic failures of the lamp 510 toward the end of its useful life. The feature of automatic shut off is accomplished by measuring the power consumed by the lamp 510 by sensing the current leaving a lamp network 520 and the corresponding voltage. These features of power regulation and automatic shutoff are not affected by variations in the temperature of the lamp 290.

In FIG. 3, the PFC circuit 400 has two output terminals across which a regulated direct-current voltage $VDC_2$ is provided for supplying the lamp network 520 and the lamp 510 with power. The voltage $VDC_2$ is preferably between 380 and 460 volts. An AC power source (not shown) supplies power to the PFC circuit 400. A first output terminal of the PFC circuit 400 is coupled to a first terminal of the switch 530. A second terminal of the switch 530 is coupled to an input terminal of the lamp network 520 and to a first terminal of the switch 540. A second terminal of the switch 540 is coupled to a second terminal of the lamp network 520, to first terminal of a resistor 410 and to a first terminal of a resistor 420, thereby forming a node N3. A second terminal of the resistor 410 is coupled to a second output terminal of the PFC circuit 400 and to a ground node. A second terminal of the resistor 420 is coupled to a positive terminal of a capacitor 430, to a positive input terminal of a comparator 490, thereby forming a node N4. A negative terminal of the capacitor 430 is coupled to the ground node.

The lamp network 520 has two output terminals. A first output terminal of the lamp network 520 is coupled to a first terminal of the lamp 510. Additionally, a second output terminal of the lamp network 520 is coupled to a second terminal of the lamp 510.

An anode terminal of a diode 500 is coupled to the second terminal of the lamp 510 via a current transformer such that a voltage associated with the second terminal of the lamp 510 is not shared with the anode terminal of the diode 500. Instead, the anode terminal of the diode 500 receives a current representative of a current that flows through the lamp 510.

A cathode terminal of the diode 500 is coupled to a positive terminal of a capacitor 440, to a first terminal of a potentiometer 450, and to a negative terminal of an amplifier 460, thereby forming a node N5. A negative terminal of the capacitor 440 and a second terminal of the variable resistor 450 are coupled to the ground node. A current through the lamp 510 develops a voltage across the potentiometer 450, thereby forming a voltage $V_{N5}$ at the node N5. The voltage $V_{N5}$ is smoothed by the capacitor 440 and potentiometer 450 and is, therefore, representative of a level of current supplied to the lamp 510 over several cycles of the switches 530 and 540. This potentiometer 450, however, is user adjustable so as to vary this voltage level. Because the voltage $VDC_2$ is regulated, the voltage $V_{N5}$ is representative of a level of power provided to the lamp 510.

A positive terminal of the amplifier 460 is biased to a voltage VC. Preferably, the voltage VC is approximately 1 volt. An output terminal of the amplifier 460 is coupled to an input terminal of a voltage controlled oscillator (VCO) 470. The VCO 470 has two output terminals, OUTB and $\overline{\text{OUTB}}$. A first output terminal OUTB and is coupled to control the switch 540. Further, a second output terminal $\overline{\text{OUTB}}$ is coupled to control the switch 530. The voltage levels at the terminals OUTB and $\overline{\text{OUTB}}$ are complementary such that one, and only one, of the switches 530 and 540 is on (closed) at any one time while the other is off (open).

The power provided to the lamp network 520 is regulated according the frequency at which the VCO 470 operates the switches 530 and 540. More particularly, the power is inversely related to the frequency over a certain range of frequencies. The frequency of the VCO 470 is controlled according to a difference between the voltage level $V_{N5}$ at the node N5 and a voltage $VTH_2$. Thus, the illumination intensity of the lamp 510 is adjustable by the user adjusting the potentiometer 450. Further, a feedback loop is formed by the amplifier 460, the VCO 470, and the switches 530 and 540 for regulating the voltage $V_{N5}$ at the node N5. Thus, by controlling the voltage at the node N5 in a feedback loop, the power provided to the lamp 510 is controlled such that the user selected illumination intensity output for the lamp 510 is maintained despite variations in temperature of the lamp or impedance changes caused by aging.

A negative input terminal of the comparator 490 is biased to a predetermined threshold voltage $VTH_2$. An output terminal of the comparator 490 is coupled to set input terminal S of an RS flip flop 480. An output terminal Q of the RS flip flop 480 is coupled to a disable switching in the PFC circuit 400 and VCO 470 thereby disabling the PFC circuit 400 and the VCO 470. A reset input R on the RS flip flop 480 is coupled to an under-voltage (UV) signal for re-setting the flip flop 480. The RS flip flop 480 delivers lamp shut off signal $DISABLE_2$ to the PFC 400 and the VCO 470 when the voltage at the positive terminal of the comparator 240 exceeds the predetermined threshold voltage $VTH_2$.

These elements of the present invention automatically shut off the lamp 510 when the lamp nears the end of its useful life. For example, operation in partial rectification can trigger shut down of the lamp 510. To implement this function, the DC voltage at the node N4 is supplied to the comparator 490. When the voltage $V_{N4}$ at the node N4 exceeds the predefined threshold voltage $VTH_2$, this indicates that the power provided to the lamp 510 can no longer controlled to an appropriate level due to deterioration of the lamp 510. Accordingly, the comparator 490 sets the RS flip flop 480, which in turn deactivates the PFC 400 and the VCO 470, thereby shutting off power to the lamp 510. The predefined threshold voltage $VTH_2$ is preferably set at a level higher than a typical, normal voltage at the node N4 during safe operation of the lamp 510 such that the comparator 490 provides the signal to shut off power to the lamp 510 only when the voltage at the node N4 reaches unsafe levels.

In the preferred embodiment, the output terminal Q of the RS flip flop 480 disables the PFC 400 and the VCO 470 by disabling a clock signal (not shown) utilized for controlling switching in the PFC circuit 400 and the VCO 470. When the PFC 400 and the VCO 470 are shut down, the voltage $VDC_2$ falls to low level and little or no power is supplied to the lamp network 520 or to the lamp 510.

Figure 4A:
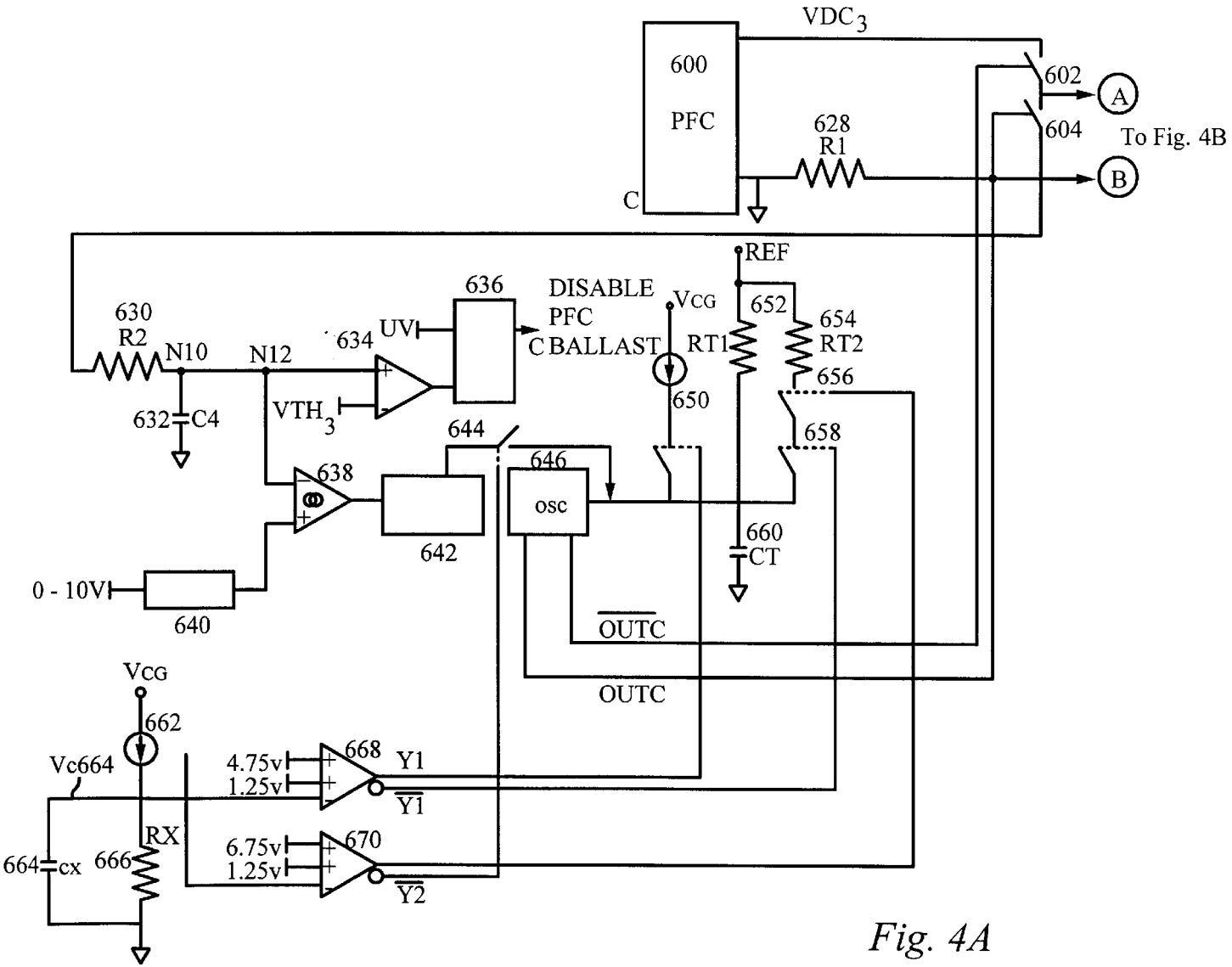
FIG. 4A illustrates a preferred embodiment of the present invention showing a first portion of a circuit for regulating power received by a gas discharge lamp to maintain a constant illumination, dimming the lamp to a low level, shutting down the lamp before partial rectification occurs, and selecting a proper operating frequency.
Figure 4B:
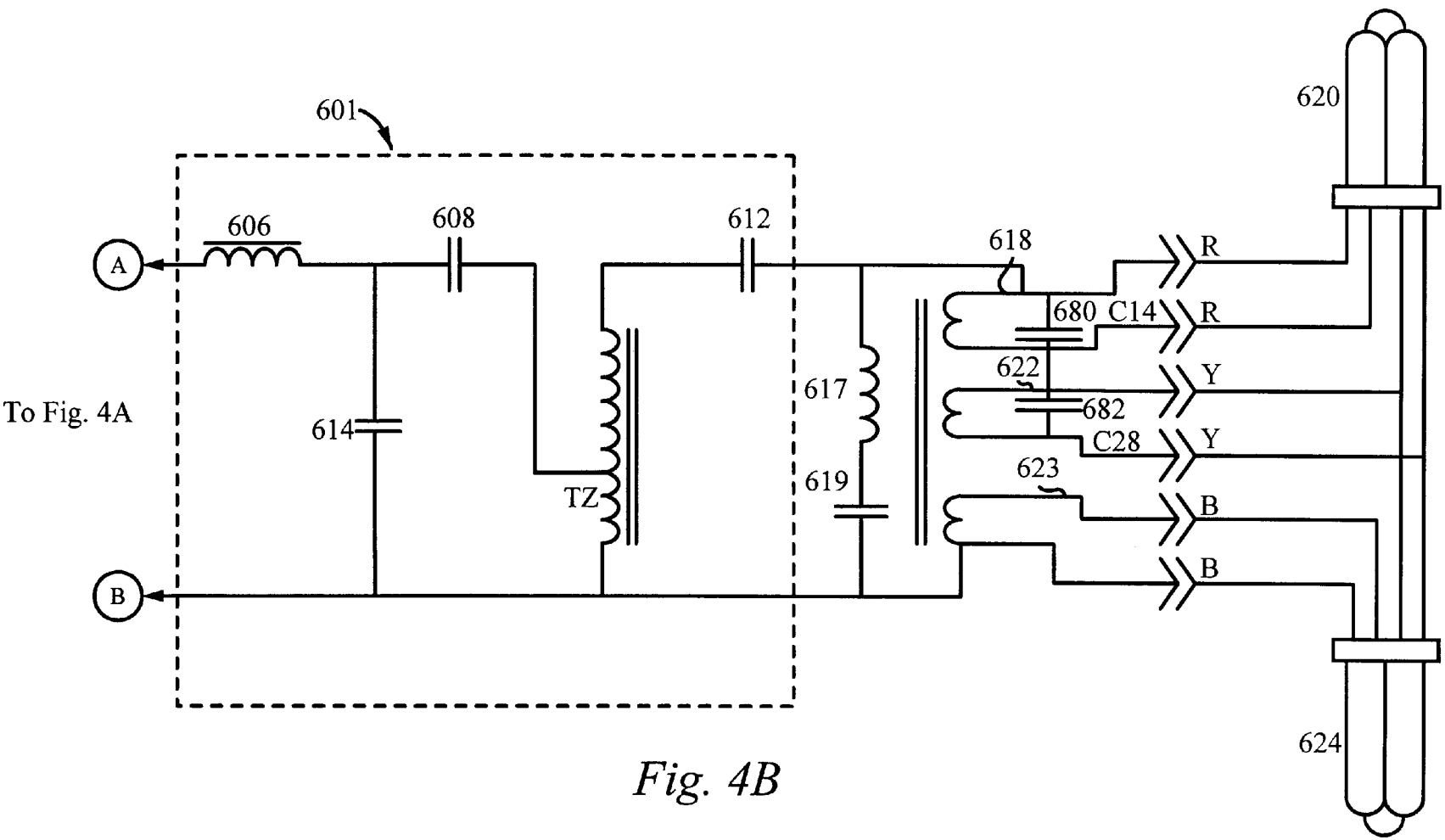
FIG. 4B illustrates a preferred embodiment of the present invention showing a second portion of the circuit referenced in FIG. 4A.

A circuit, shown in FIGS. 4A and 4B, which in addition to the functions of power regulation and automatic power shut off, implemented by the circuits illustrated in FIGS. 2 and 3, operates gas discharge lamps 620, 624 more efficiently by preferably utilizing one of a plurality of predetermined switching frequencies for switches 602 and 604. Preferably, each of these predetermined frequencies is designed for a different mode of lamp operation, such as preheating, starting or continuous operation. Additionally, each of these frequencies which is associated with a corresponding mode of lamp operation is preferably adjustable to maximize the lamp's efficiency and longevity. Further, FIGS. 4A and 4B also display a circuit which operates the attached lamp in the continuous operation mode at as low as 5% or lower of it's rated light output. This feature is referred to as "deep dimming" or "architectural dimming" and provides increased flexibility and efficiency for the lamp user.

In FIG. 4A, a power factor corrector (PFC) circuit 600 has two output terminals across which a regulated direct-current voltage $VDC_3$ is provided for supplying a lamp network 601 (FIG. 4B) and the lamps 620, 624 (FIG. 4B) with power. A first output terminal of the PFC 600 is coupled to a first terminal of a switch 602. A second terminal of the switch 602 is coupled to a first terminal of a switch 604 and to a node A which also corresponds to the node A located in FIG. 4B.

A node B in FIG. 4A corresponds to the node B located in FIG. 4B. The node B is coupled to a second terminal of the switch 604, a first terminal of a resistor 628, and a first terminal of a resistor 630, thereby forming a node N10 in FIG. 4A. A second terminal of the resistor 628 is coupled to a second output terminal of the PFC 600 and to a ground node. A second terminal of the resistor 630 is coupled to a positive input terminal of a comparator 634, a negative input terminal of an amplifier 638, and a positive terminal of a capacitor 632, thereby forming a node N12. A negative terminal of the capacitor 632 is coupled to ground. A negative terminal of the comparator 634 is biased to a voltage $VTH_3$. The current from the lamps 620, 624 flow through the resistor 628 and establishes a voltage $V_{N10}$ at a node $N_{10}$. The resistor 630 and the capacitor 632 form a low pass filter. As a result of this low pass filter, the voltage $V_{N12}$ at node N12 is a DC or average voltage. The positive terminal of the comparator 634 and the negative terminal of the comparator 638 both sense $V_{N12}$. Because the voltage $VDC_3$ is regulated, the voltage $V_{N12}$ is representative of a level of power provided to the lamps 620, 624.

An output terminal of the comparator 634 is coupled to set input terminal S of a flip flop 636. A reset terminal R of the flip flop 636 is coupled to a voltage UV. An output terminal Q of the flip flop 636 is coupled to a terminal "C" to disable switching in the PFC 600.

An attenuator 640 is coupled to a positive terminal of the amplifier 638. The attenuator 640 is preferably configured to supply from 0 to 10 volts. An output terminal of the amplifier 638 is coupled to an input terminal of a voltage-to-current converter 642. An output terminal of the voltage-to-current converter 642 is coupled to a first terminal of a switch 644. The voltage to current converter 642 takes a voltage V at the input terminal of converter 642 and provides a current I at the output terminal of converter 642 where the current I is inversely proportional to the voltage V. A second terminal of the switch 644 is coupled to a control terminal of an oscillator 646, a first terminal of a switch 650, a first terminal of a resistor 652, a positive terminal of a capacitor 660, and a first terminal of a switch 658.

An output terminal OUTC of the oscillator 646 is coupled to control the switch 604. An output terminal $\overline{OUTC}$ of the oscillator 646 is coupled to control the switch 602. The voltage levels of OUTC and $\overline{OUTC}$ are complementary in that one, and only one, of the switches 602 and 604 is on (closed) at any one time while the other is off (open). An input terminal of a current source 648 is coupled to a voltage VCC. An output terminal of the current source 652 is coupled to a second terminal of the switch 650. Additionally, a second terminal of the resistor 652 is coupled to a first terminal of a resistor 654. A second terminal of the resistor 654 is coupled to a first terminal of a switch 656. A second terminal of the switch 656 is coupled to a second terminal of the switch 658.

Finally, an input terminal of a current source 662 is coupled to the voltage VCC. An output terminal of the current source 662 is coupled to a negative input terminal of a comparator 668, a negative input terminal of a comparator 670, a first terminal of a resistor 666, and a positive terminal of a capacitor 664. A negative terminal of the capacitor 664 and a second terminal of the resistor 666 are coupled to ground. A first positive input terminal of the comparator 668 is preferably biased to 4.75 volts. Additionally, a second positive input terminal of the comparator 668 is also preferably biased to 1.25 volts. A first positive input terminal of the comparator 670 is preferably biased to 6.75 volts. Additionally, a second positive input terminal of the comparator 670 is also preferably biased to 1.25 volts. A first output terminal of the comparator 668 is coupled to control line the switch 650. A second output terminal of the comparator 668 is coupled to control line the switch 658. The second output terminal of the comparator 668 produces signals that are complementary to signals produced by the first output terminal of the comparator 668. A first output terminal of the comparator 670 is coupled to a control line for the switch 656. A second output terminal of the comparator 670 is coupled to a control line for the switch 644. The second output terminal of the comparator 670 produces signals that are complementary to signals produced by the first output terminal of the comparator 668.

In FIG. 4B, the node A is coupled to a first terminal of an inductor 606. A second terminal of the inductor 606 is coupled to a first terminal of a capacitor 608 and a first terminal of a capacitor 614. A second terminal of the capacitor 608 is coupled to a center tapped lead of an autotransformer T2. A first terminal of a capacitor 612 is coupled to a first end terminal of the autotransformer T2. A first terminal of a primary winding 617 of a filament transformer T1 is coupled to a second end terminal of the capacitor 612, a first terminal of a capacitor 680, a first terminal of a first secondary winding 618 of the transformer T1, and a first terminal of the lamp 620. A second terminal of the first secondary winding 618 is coupled to a second terminal of the lamp 620. A second terminal of a third secondary winding 623 of the transformer T1 is coupled to a first terminal of a lamp 624, a second end terminal of the autotransformer T2, a second terminal of the capacitor 614, and the node B which corresponds to the node B found in FIG. 4A.

A second terminal of a second secondary winding 622 is coupled to a third terminal of the lamp 620 and a third terminal of the lamp 624. A second terminal of the capacitor 680 is coupled to a first terminal of a capacitor 682. A second terminal of the capacitor 682 is coupled to a first terminal of the second secondary winding 622 of the transformer T1, a fourth terminal of the lamp 620, and a fourth terminal of the lamp 624. A first terminal of a third secondary winding 623 of the transformer T1 is coupled to a second terminal of the lamp 624. Further, a first terminal of a capacitor 619 is coupled to a second terminal of the primary winding 617 of the transformer T1.

By the oscillator 646 controlling the frequency of opening and closing the switches 602 and 604, the power to a lamp network 601 is regulated. Further, a feedback loop is formed by the amplifier 638, the oscillator 646, and switches 602 and 604. Thus, by monitoring the current flowing through the lamp network 601 which is sensed at the node N10, the oscillator 646 automatically maintain the user selected illumination intensity output from the lamps 620, 624.

The circuit in FIG. 4A also automatically shuts off the lamps 620, 624 when the lamps 620, 624 near the end of their useful lives. To achieve this function, the DC voltage $V_{N12}$ at the node N12 is supplied to the comparator 634. When the voltage $V_{N12}$ at the node N12 exceeds the predefined threshold voltage $VTH_3$, the comparator 634 sets the RS flip flop 636, which in turn deactivates the PFC 600 and the oscillator 646 thereby shutting off power to the lamps 620, 624. The predefined threshold voltage $VTH_3$ is preferably set at a level higher than a typical, normal voltage at the node N12 during safe operation of the lamps such that the comparator 634 gives the signal to shut off power when the voltage at the node N12 only reaches unsafe levels. The output terminal Q of the RS flip flop 636 disables the PFC 600 and the oscillator 646 by disabling a clock signal (not shown) utilized for switching in the PFC 600 and the oscillator 646. With the clock shut down, little or no power is supplied to the lamp network 601 or the lamps 620, 624.

Figure 5:
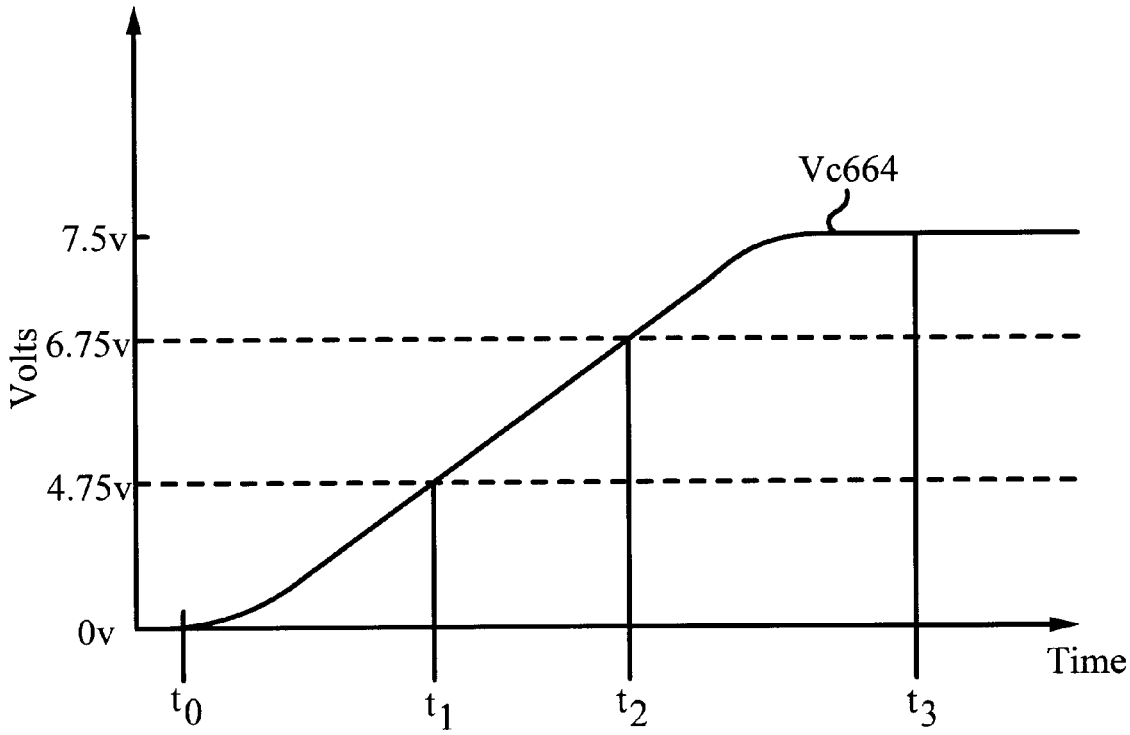
FIG. 5 illustrates a timing chart showing three different phases of operation for the preferred embodiment.

Three modes of operation for the circuit disclosed in FIG. 4A are graphically shown on the chart of FIG. 5. Below, Table 1 shows the corresponding state of the switches 650, 658, 656 and 644 relative to the three operating modes of the lamps 620, 624.

TABLE 1

| | Preheating | Starting | Continuous Operation |
|---|---|---|---|
| Switch 650 | ON | OFF | OFF |
| Switch 658 | OFF | ON | ON |
| Switch 656 | ON | ON | OFF |
| Switch 644 | OFF | OFF | ON |

When the circuit illustrated in FIGS. 4A and 4B is off, the current source 662 is off. Accordingly, a voltage $V_{C664}$ across the capacitor 664 is discharged through the resistor 666 to a level below 1.25 volts. Upon start-up at time $t_0$, the current source 662 turns on, which slowly increases the voltage across the capacitor 664. Eventually, at the time ($t_1$), the voltage $V_{C664}$ reaches 4.75 volts. Thus, between the times $t_0$ and $t_1$ (preheating mode), the comparators 668, 670 control the switches 650, 656 to be on (closed), and the switches 658, 644 to be off (open). Under these conditions, the current source 648 charges the timing capacitor 660 at a rate appropriate to set the frequency of the oscillator 646 for preheating the lamps 620, 624. Note that the timing resistor 652 affects this preheating frequency as does a dead time characteristic of the oscillator 646. Because the switch 658 is open, however, the resistor 654 does not affect the preheating frequency.

During preheating, the filaments inside the lamps 620, 624 are warmed to their emission temperature while, the voltage supplied to the lamps 620, 624 is sufficiently low to prevent the lamps from igniting. Preheating the lamps 620, 624 prior to ignition is important to prolong the useful life of the lamps 620, 624.

Eventually, at the time $t_2$, the voltage $V_{C664}$ reaches 6.75 volts. Thus, between the times $t_1$ and $t_2$ (starting mode), the frequency of the oscillator 646 is no longer influenced by the current source 648. Rather, because the switches 656 and 658 are both closed, the frequency of the oscillator 646 is influenced by the resistor 654. As a result, during the starting mode the frequency at which the switches 602 and 604 are operated is reduced significantly. This significantly increases the voltage level supplied to the lamps 620, 624 so as to ensure ignition.

Then, once the voltage $V_{C664}$ has exceeded 6.75 volts, (after the time $t_2$), the continuous operation mode is entered in which the comparators 668, 670 control switches 644, 658 to be closed and the switches 656, 650 to be open. Under these conditions, the frequency of the oscillator 646 is no longer influenced by the resistor 654. Rather, because the switch 644 is closed, the frequency of the oscillator 646 is influenced by a feedback signal $I_{operate}$ which is provided to the oscillator 646 by the voltage-to-current converter 642. The continuous operation frequency results in a lower power being provided to the lamps 620, 624 in comparison to the starting mode, so that the lamps 620, 624 draw an appropriate level of power to keep the illumination intensity at the preselected level desired by the user.

In the preferred embodiment, the capacitor 660 has a value of 1.5 nF, the resistor 652 is 14.5 Kohms and the resistor 654 is 73.1 Kohms. Further, during the preheating mode, the switches 602, 604 are preferably operated at 70 KHz. During the starting mode, the switches 602, 604 are preferably operated at 50 KHz. In addition, during the continuous operation mode, the switches 602, 604 are operated between 42.3 KHz for maximum intensity to a frequency which results in deep dimming to 5% or less of the maximum rated output for the lamps 620, 624. It will be apparent, however, that other component values and frequencies can be selected.

Returning to FIGS. 4A and 4B, another important feature of this circuit allows the lamps 620, 624 to operate when they are deeply dimmed down to 5% or less of the lamps' rated illumination output. Compact lamps are known for their characteristic of driving themselves into an area of high negative resistance when dimmed and causing an associated lamp network to have an increased quality factor Q. This increased quality factor Q caused the lamps to extinguish or flicker excessively when they were dimmed. As stated herein, prior circuits attempted to solve this problem by utilizing a low pass network to allowing dimming down to 40%.

Recall the lamp network 601 illustrated in FIG. 4B includes the capacitors 608 and 612; the transformer T1; the autotransformer T2; and the inductor 606. The configuration of this lamp network as shown in FIG. 4B provides a lower quality factor Q than the prior art while the attached lamps are being dimmed. In fact, the lamps can be deeply dimmed down to 5% or lower and still operate without excessively flickering or extinguishing. The lamp network 601 provides a low pass filter followed by the autotransformer T2 and capacitors 608, 612 which acts as a high pass filter. This network combination of first the low pass filter, followed by the high pass filter, allows the lamp network 601 to have a lower quality factor Q while the coupled lamps 620, 624 are being dimmed. For example, as seen through the nodes A and B of the lamp network 601, the capacitor 614 and inductor 606 are configured to act as a low pass filter which is followed by the autotransformer T2 acting as a high pass filter. As a result of the lamp network 601, the lamps 620 and 624 are configured to have signals pass first through a low pass filter and then through an autotransformer acting as a high pass filter. This allows the lamps 620, 624 to be dimmed down to less than 5% of their rated illumination and still operate satisfactorily.

Figure 6:
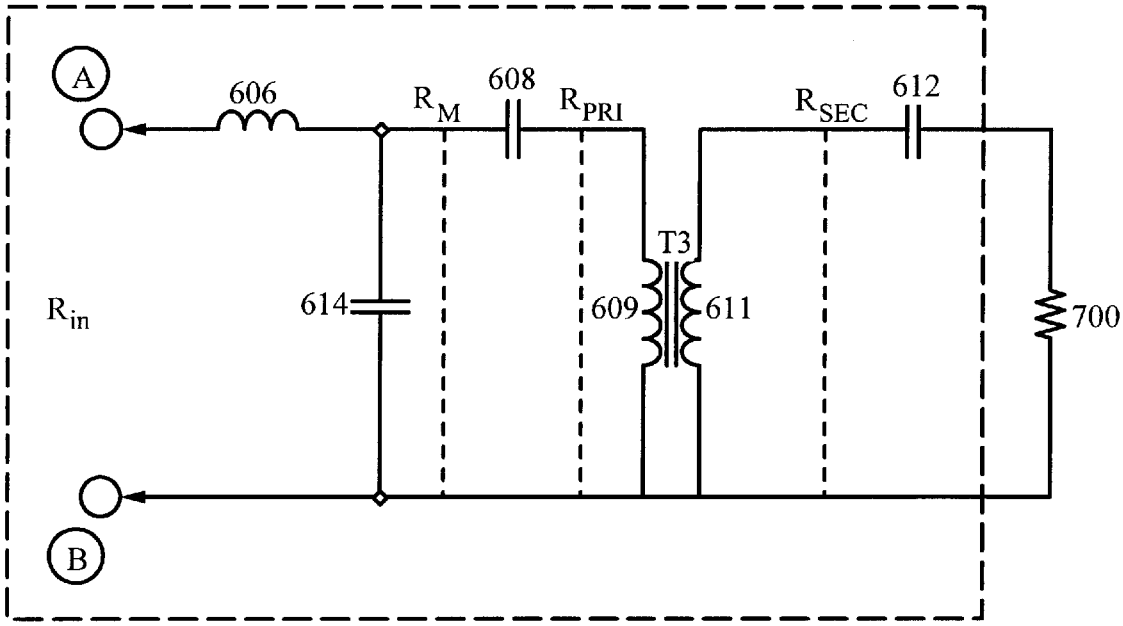
FIG. 6 illustrates the equivalent circuit of the lamp network shown in the preferred embodiment of FIG. 4B.

FIG. 6 illustrates an equivalent circuit for the lamp network 601 described above and illustrated in FIG. 4B. Where appropriate, the same reference numbers are utilized to describe common elements. An impedance $R_L$ 700 replaces the lamps 620 and 624; the capacitors 619, 680, and 682; and the transformer T1 which are outside the lamp network 601 and found in FIG. 4B. As stated before, the unique lamp network 601 shown in FIG. 4B retains a low quality factor Q even while the lamps are deeply dimmed.

A transformer T3 is shown as a conventional transformer with a primary winding 609 and a secondary winding 611. In FIG. 6, the transformer T3 produces an equivalent result as the autotransformer T2 (FIG. 4B) and is merely substituted for the autotransformer T2 as shown in FIG. 4B. To overcome the shortcomings of the prior art, the transformer T3 is a part of a high pass filter which follows a low pass filter formed by the inductor 606 and the capacitor 614.

There is a large increase in voltage across the lamps when they are dimmed which also indicates an increase in quality factor Q when operated from prior art circuits. However, to supply this increasingly large voltage to the lamps as they are dimmed, a low quality factor Q is needed. To overcome this performance contradiction, the high pass filter formed by the transformer T3 and capacitors 608 and 612 follows the low pass filter formed by the inductor 606 and the capacitor 614. It will be apparent, however, that this transformer T3 of the high pass filter can be substituted for another element which has the necessary inductive reactance to act as the shunt element for the high pass filter.

An input quality factor $Q_{in}$ of the lamp network 601 is seen through the nodes A and B. The high pass filter formed by the transformer T3 and capacitors 608 and 612 lowers the output quality factor $Q_{out}$ of the lamp network 601. Instead of being driven directly by the inductor 606 and the capacitor 614, the lamps, which are represented by the impedance $R_L$ 700, are driven by the series capacitor 612 which decreases its Q as the lamps are dimmed. To appropriately shape the frequency response of the lamp network 601, the input quality factor $Q_{in}$ of the low pass filter is made larger than the output quality factor $Q_{out}$ of the high pass filter.

As the lamps 620 and 624 are dimmed, the output quality factor $Q_{out}$ decreases. The transformation between parallel capacitive reactance and series capacitive reactance is shown in Eq. 1 below.

$$X_{para\,C} = X_{series\,C} * \left(1 + \frac{1}{Q_{out}^2}\right) \qquad \text{Eq. (1)}$$

Accordingly, an equivalent parallel reactance $X_{ParaC612}$ of the capacitor 612 in series becomes larger.

Figure 7:
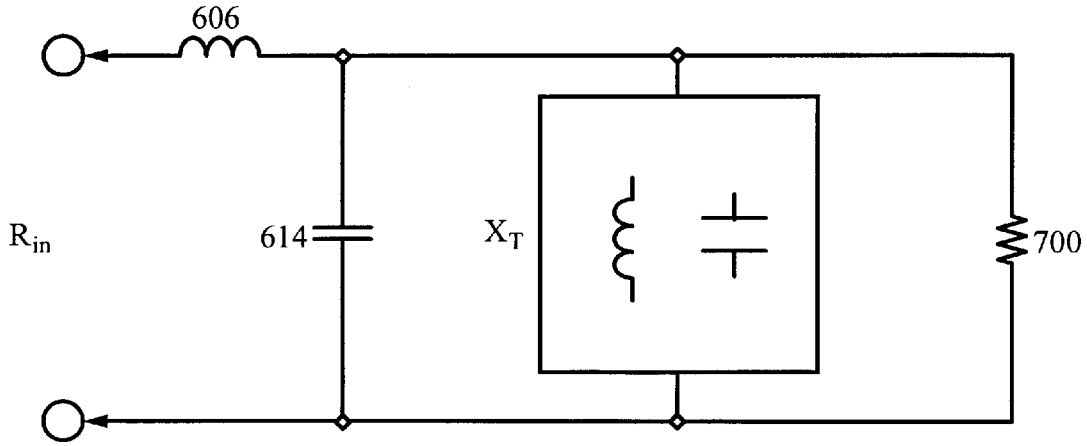
FIG. 7 shows the equivalent circuit shown in the lamp network of FIG. 6.

The parallel reactance $X_{ParaC612}$ of the capacitor 612 is then combined with a reactance of the secondary winding 611 of the transformer T3 and then transformed onto a side of the primary winding 609. The parallel reactance $X_{ParaC612}$ combined with the reactance of the secondary winding 611 of the transformer T3 and then transformed onto the same side as the primary winding 609 is shown in FIG. 7 and labeled reactance $X_T$.

An input quality factor $Q_M$ of the high pass filter is shown below in Eq. 2 and given by:

$$Q_M = \left(\frac{R_{PRI}}{R_M} - 1\right)^{1/2} \quad \text{Eq. (2)}$$

The input quality factor $Q_M$ of the high pass filter is very small. The reactance of the capacitor 608 is given by Eq. 3:

$$X_{C608} = Q_M * R_M \quad \text{Eq. (3)}$$

According to the above Eqs. 2 and 3, a reactance $X_{C608}$ of the capacitor 608 is also very small which allows the reactance $X_T$ to be positioned in parallel with the capacitor 614 as seen in FIG. 7.

As the impedance 700 gets larger and the reactance $X_T$ becomes more inductive, the combined reactance of $X_T$ and the parallel reactance $X_{ParaC612}$ becomes larger thus causing the input quality factor $Q_{in}$ of the lamp network 601 to be lowered.

As a result of the low pass filter created by the inductor 606 in conjunction with the capacitor 614 followed by the high pass filter created by the transformer T3, the overall quality factor Q of the lamp network preferably remains low during deep dimming. It will be apparent to those skilled in the art to select components such as resistors, capacitors, and inductors with appropriate values depending on the desired response for the overall quality factor Q for the lamp network 601.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

Specifically, it will be apparent to one of ordinary skill in the art that the device of the present invention could be implemented in several different ways and the apparatus disclosed above is only illustrative of the preferred embodiment of the invention and is in no way a limitation. For example, it would be within the scope of the invention to vary the values of the various components and voltage levels disclosed herein.

What is claimed is:

1. A method of controlling an illumination intensity of a gas discharge lamp comprising the steps of:

a. in a variable frequency ballast circuit, sensing a power drawn by the lamp;

b. comparing the power drawn by the lamp to a reference signal;

c. adjusting a frequency of the ballast circuit; and d. a lamp network circuit for dimming the lamp further comprising:

(A) a low pass filter; and (B) a high pass filter coupled to the low pass filter wherein the high pass filter follows the low pass filter such that the lamp network has a low quality factor.

2. A method of preventing a catastrophic failure in a gas discharge lamp comprising the steps of:

a. in a variable frequency ballast circuit, sensing a power drawn by the lamp;

b. comparing the power drawn by the lamp to a maximum threshold reference signal;

c. halting operation of the variable frequency ballast when the power drawn by the lamp exceeds the maximum threshold reference signal; and d. dimming the lamp using a low pass filter: and a high pass filter coupled to the low pass filter wherein the high pass filter follows the low pass filter such that the lamp network has a low quality factor.

3. An apparatus for controlling an illumination intensity of a gas discharge lamp comprising:

a. a variable frequency ballast circuit for sensing a power drawn by the lamp;

b. means for comparing the power drawn by the lamp to a reference signal wherein the means for comparing is coupled to the ballast circuit; and c. means for adjusting a frequency of the ballast circuit in response to an input from the means for comparing wherein the means for adjusting is coupled to the ballast circuit; and d. a lamp network circuit for dimming the lamp further comprising:

(A) a low pass filter; and (B) a high pass filter coupled to the low pass filter wherein the high pass filter follows the low pass filter such that the lamp network has a low quality factor.

4. The apparatus according to claim 3 further comprising a frequency circuit for optimizing a plurality of operating frequencies and selecting from the plurality of operating frequencies including:

a. means for optimizing the plurality of operating frequencies with respect to a plurality of modes such that each operating frequency is optimized for the ballast circuit functioning in a particular mode of operation; and b. means for selecting a proper operating frequency from among the plurality of operating frequencies.

5. The apparatus according to claim 4 wherein the plurality of modes comprises a starting mode, a preheating mode, and a continuous operation mode.

6. An apparatus for controlling an illumination intensity of a gas discharge lamp comprising:

a. a variable frequency ballast for providing electric power to the lamp;

b. a sensing circuit coupled to the frequency ballast for sensing an amount of power drawn by the lamp and forming a signal representative of the power;

c. a generating circuit coupled to the sensing circuit for generating a reference signal;

d. a comparator circuit coupled to the generating circuit for comparing the signal representative of the power to the reference signal;

e. an adjusting circuit coupled the comparator circuit for adjusting an operating frequency of the variable frequency ballast in response to a difference between the signal representative of the power and the reference signal circuit; and f. a lamp network circuit for dimming the lamp further comprising:

(A) a low pass filter; and (B) a high pass filter coupled to the low pass filter wherein the high pass filter follows the low pass filter such that the lamp network has a low quality factor.

7. The apparatus according to claim 6 further comprising a circuit for preventing a catastrophic failure which includes:

a. a circuit for generating a maximum threshold level;

b. a comparator for comparing the maximum threshold level to the signal representative of the power; and c. means for disabling the variable frequency ballast if the signal representative of the power exceeds the maximum threshold level.

8. The apparatus according to claim 6 wherein the adjusting circuit for adjusting the operating frequency of the variable frequency ballast comprises a voltage controlled oscillator.

9. The apparatus according to claim 6 further comprising means for adjusting the reference signal for modifying the illumination intensity.

10. The apparatus according to claim 6 further comprising means for adjusting the signal representative of the power for modifying the illumination intensity.

11. An apparatus for preventing a catastrophic failure of a gas discharge lamp comprising:

a. a variable frequency ballast for providing electric power to the lamp;

b. a sensing circuit coupled to the frequency ballast for sensing an amount of power drawn by the lamp and forming a signal representative of the power;

c. a generating circuit coupled to the frequency ballast for generating a maximum threshold level;

d. a comparator coupled the generating circuit for comparing the maximum threshold level to the signal representative of the power;

e. means for disabling the variable frequency ballast if the signal representative of the power exceeds the maximum threshold wherein the means for disabling is coupled to the frequency ballast and f. a lamp network circuit for dimming the lamp further comprising:

(A) a low pass filter; and (B) a high pass filter coupled to the low pass filter wherein the high pass filter follows the low pass filter such that the lamp network has a low quality factor.

12. A circuit for disabling a lamp ballast circuit comprising:

a. an input node for receiving a current signal proportional to a power signal provided to a lamp network by the lamp ballast circuit;

b. a resistor having two terminals, a first resistor terminal coupled to the input node;

c. a capacitor having two terminals, a first capacitor terminal coupled to a second resistor terminal and a second capacitor terminal coupled to a ground potential, wherein the capacitor forms a comparison voltage at the first capacitor terminal;

d. a comparator having a positive input coupled to the first capacitor terminal and a negative input coupled to a threshold voltage;

e. a latch coupled to the comparator, for receiving and holding a comparison output signal from the comparator wherein the latch is coupled to disable the lamp ballast circuit when the comparison voltage exceeds the threshold voltage; and f. a lamp network circuit for dimming the lamp further comprising:

(A) a low pass filter; and (B) a high pass filter coupled to the low pass filter wherein the high pass filter follows the low pass filter such that the lamp network has a low quality factor.

13. A circuit for regulating power to a lamp ballast circuit comprising:

a. an input node for receiving a current signal proportional to a power signal provided to a lamp network by the lamp ballast circuit;

b. a resistor having two terminals, a first resistor terminal coupled to the input node;

c. a capacitor having two terminals, a first capacitor terminal coupled to a second resistor terminal and a second capacitor terminal coupled to a ground potential, wherein the capacitor forms a comparison voltage at the first capacitor terminal;

d. a comparator having a positive input coupled to an adjustable reference voltage formed by an attenuator and a negative input coupled to the first capacitor terminal;

e. a voltage controlled oscillator with an oscillator input coupled to the comparator and an oscillator output coupled to the lamp network wherein the voltage controlled oscillator adjusts a frequency of the power signal such that a selectable level of illumination from the lamp network remains constant; and f. a lamp network circuit for dimming the lamp further comprising:

(A) a low pass filter; and (B) a high pass filter coupled to the low pass filter wherein the high pass filter follows the low pass filter such that the lamp network has a low quality factor.

14. A circuit for dimming a gas discharge lamp comprising:

a. an inverter coupled to the gas discharge lamp; and b. a lamp network coupled between the inverter and the gas discharge lamp wherein the lamp network receives power from the inverter and delivers the power to the gas discharge lamp, the lamp network comprising a low pass filter followed by a high pass filter thereby enabling deep dimming of the lamp.

15. A circuit for selecting and optimizing an operating frequency for a gas discharge lamp comprising:

a. a variable frequency ballast coupled to the gas discharge lamp;

b. means for optimizing a plurality of operating frequencies such that each operating frequency is optimized for the ballast and the gas discharge lamp functioning in one of a plurality of operation modes wherein the means for optimizing is coupled to the frequency ballast;

c. means for selecting a proper operating frequency from among the plurality of operating frequencies wherein the means for selecting is coupled to the frequency ballast; and d. a lamp network circuit for dimming the lamp further comprising:

(A) a low pass filter; and (B) a high pass filter coupled to the low pass filter wherein the high pass filter follows the low pass filter such that the lamp network has a low quality factor.

16. The circuit as claimed in claim 15 wherein the plurality of operation modes include a preheat mode, a starting mode, and a continuous operation mode.

17. An apparatus for controlling an illumination intensity of a gas discharge lamp comprising:

a. a variable frequency ballast circuit for sensing a current through the lamp;

b. a frequency controller coupled to the variable frequency ballast circuit for adjusting a frequency of the ballast circuit in response to the current; and c. a lamp network coupled to the frequency controller wherein the lamp network has a low pass filter followed by a high pass filter.

18. An apparatus for controlling an illumination intensity of a gas discharge lamp and disabling the gas discharge lamp comprising:

a. a variable frequency ballast circuit for sensing a current through the lamp;

b. a frequency controller coupled to the variable frequency ballast circuit for adjusting a frequency of the ballast circuit in response to the current;

c. a sensing circuit coupled to the ballast circuit for sensing a power drawn by the lamp;

d. a comparator circuit coupled to the sensing circuit for comparing the power drawn by the lamp to a predetermined threshold;

e. a disabler circuit coupled to the comparator circuit for halting operation of the ballast circuit when the power drawn exceeds the predetermined threshold; and f. a lamp network circuit for dimming the lamp further comprising:

(A) a low pass filter; and (B) a high pass filter coupled to the low pass filter wherein the high pass filter follows the low pass filter such that the lamp network has a low quality factor.

* * * * *

UNITED STATES PATENT AND TRADEMARK OFFICE

CERTIFICATE OF CORRECTION

PATENT NO. : 6,232,727 B1
DATED : May 15, 2001
INVENTOR(S) : Chee et al.

It is certified that error appears in the above-identified patent and that said Letters Patent is hereby corrected as shown below:

Title page,
Assignee, please delete "Micro Linear Corporation, San Jose, CA" and replace with -- Fairchild Semiconductor Corporation, South Portland, ME --.
References Cited,
After Patent Number "4,528,482", please replace the date "6/1985" with -- 7/1985 --.
Please insert -- 4,704,563 11/1987 Hussey.....315/307 -- after the reference "4,700,113", and before the reference "4,717,863".
After the Patent Number "4,893,059", please replace "Nillsen" with -- Nilssen --.
After the Patent Number "4,935,669", please replace "Nillsen" with -- Nilssen --.
After the Patent Number "4,952,849", please replace "Fallows et al." with -- Fellows et al. --.

Signed and Sealed this

Fourteenth Day of May, 2002

*Attest:*

*Attesting Officer*

JAMES E. ROGAN
*Director of the United States Patent and Trademark Office*